US009518230B2

(12) United States Patent
Hoehn et al.

(10) Patent No.: US 9,518,230 B2
(45) **Date of Patent: *Dec. 13, 2016**

(54) PROCESS FOR RECOVERING HYDROPROCESSED HYDROCARBONS WITH TWO STRIPPERS

(75) Inventors: Richard K. Hoehn, Mount Prospect, IL (US); David M. Bowman, Cary, IL (US); Xin X. Zhu, Long Grove, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/213,310

(22) Filed: Aug. 19, 2011

(65) Prior Publication Data

US 2013/0046125 A1 Feb. 21, 2013

(51) Int. Cl.
*C10G 7/00* (2006.01)
*C10G 67/00* (2006.01)

(52) U.S. Cl.
CPC ..... *C10G 7/00* (2013.01); *C10G 67/00* (2013.01); *C10G 2400/02* (2013.01); *C10G 2400/04* (2013.01); *C10G 2400/08* (2013.01)

(58) Field of Classification Search
CPC ..... C10G 47/32
See application file for complete search history.

(56) References Cited

U.S. PATENT DOCUMENTS

| | | | |
|---|---|---|---|
| 2,273,076 | A | 2/1942 | Voorhees |
| 2,998,381 | A | 8/1961 | Bushnell |
| 3,090,747 | A | 5/1963 | Slyngstad et al. |
| 3,445,378 | A | 5/1969 | De Graff |
| 3,483,119 | A | 12/1969 | Ehrler |
| 3,574,090 | A | 4/1971 | Hallman |
| 3,607,726 | A | 9/1971 | Hallman |
| 3,719,027 | A | 3/1973 | Salka |
| 3,733,260 | A | 5/1973 | Davies et al. |
| 3,772,158 | A | 11/1973 | Sarno |
| 4,016,070 | A | 4/1977 | Christman et al. |
| 4,822,480 | A | 4/1989 | Harandi et al. |
| 4,925,573 | A | 5/1990 | Vorlow |
| 5,110,444 | A | 5/1992 | Haun et al. |
| 5,120,427 | A | 6/1992 | Stine et al. |
| 5,453,177 | A | 9/1995 | Goebel et al. |
| 5,705,052 | A | 1/1998 | Gupta |
| 5,709,780 | A | 1/1998 | Ognisty et al. |
| 5,720,872 | A | 2/1998 | Gupta |
| 6,261,441 | B1 | 7/2001 | Gentry et al. |
| 6,500,309 | B1 | 12/2002 | Tung |
| 6,787,026 | B2 | 9/2004 | Farshid |
| 7,282,138 | B2 | 10/2007 | Ellis et al. |
| 7,462,276 | B2 | 12/2008 | Wang et al. |
| 7,528,290 | B2 | 5/2009 | Zimmermann et al. |
| 2001/0047952 | A1 | 12/2001 | Podrebarac et al. |

(Continued)

FOREIGN PATENT DOCUMENTS

| | | | |
|---|---|---|---|
| WO | 2011001445 | A2 | 1/2011 |

OTHER PUBLICATIONS

U.S. Appl. No. 13/213,319, filed Aug. 19, 2011, Hoehn.

(Continued)

*Primary Examiner* — Tam M Nguyen

(57) ABSTRACT

A process is disclosed for recovering hydroprocessing effluent from a hydroprocessing unit utilizing a hot stripper and a cold stripper. Only the hot hydroprocessing effluent is heated in a fired heater prior to product fractionation, resulting in substantial operating and capital savings.

14 Claims, 3 Drawing Sheets

(56) References Cited

U.S. PATENT DOCUMENTS

| | | | |
|---|---|---|---|
| 2007/0266853 | A1 | 11/2007 | Prussner et al. |
| 2008/0230441 | A1 | 9/2008 | Hunter et al. |
| 2009/0159493 | A1 | 6/2009 | Bhattacharya |
| 2009/0188837 | A1 | 7/2009 | Podrebarac |
| 2009/0214410 | A1 | 8/2009 | Blanchard et al. |
| 2010/0329936 | A1 | 12/2010 | Van Wees et al. |
| 2013/0045140 | A1 | 2/2013 | Hoehn et al. |

OTHER PUBLICATIONS

U.S. Appl. No. 13/213,327, filed Aug. 19, 2011, Hoehn.
U.S. Appl. No. 13/213,335, filed Aug. 19, 2011, Hoehn.
U.S. Appl. No. 13/213,357, filed Aug. 19, 2011, Hoehn.
U.S. Appl. No. 13/213,359, filed Aug. 19, 2011, Hoehn.
U.S. Appl. No. 13/213,205, filed Aug. 19, 2011, Hoehn.
U.S. Appl. No. 13/213,225, filed Aug. 19, 2011, Hoehn.
Search Report dated Mar. 11, 2015 for corresponding EP Appl. No. 12825585.

PROCESS FOR RECOVERING HYDROPROCESSED HYDROCARBONS WITH TWO STRIPPERS

FIELD OF THE INVENTION

The field of the invention is the recovery of hydroprocessed hydrocarbon streams.

BACKGROUND OF THE INVENTION

Hydroprocessing can include processes which convert hydrocarbons in the presence of hydroprocessing catalyst and hydrogen to more valuable products.

Hydrocracking is a hydroprocessing process in which hydrocarbons crack in the presence of hydrogen and hydrocracking catalyst to lower molecular weight hydrocarbons. Depending on the desired output, a hydrocracking unit may contain one or more beds of the same or different catalyst. Slurry hydrocracking is a slurried catalytic process used to crack residue feeds to gas oils and fuels.

Due to environmental concerns and newly enacted rules and regulations, saleable fuels must meet lower and lower limits on contaminates, such as sulfur and nitrogen. New regulations require essentially complete removal of sulfur from diesel. For example, the ultra low sulfur diesel (ULSD) requirement is typically less than about 10 wppm sulfur.

Hydrotreating is a hydroprocessing process used to remove heteroatoms such as sulfur and nitrogen from hydrocarbon streams to meet fuel specifications and to saturate olefinic compounds. Hydrotreating can be performed at high or low pressures, but is typically operated at lower pressure than hydrocracking.

Hydroprocessing recovery units typically include a stripper for stripping hydroprocessed effluent with a stripping medium such as steam to remove unwanted hydrogen sulfide. The stripped effluent then is heated in a fired heater to fractionation temperature before entering a product fractionation column to recover products such as naphtha, kerosene and diesel.

Hydroprocessing and particularly hydrocracking is very energy-intensive due to the severe process conditions such as the high temperature and pressure used. Over time, although much effort has been spent on improving energy performance for hydrocracking, the focus has been on reducing reactor heater duty. However, a large heater duty is required to heat stripped effluent before entering the product fractionation column.

There is a continuing need, therefore, for improved methods of recovering fuel products from hydroprocessed effluents. Such methods must be more energy efficient to meet the increasing needs of refiners.

BRIEF SUMMARY OF THE INVENTION

In a process embodiment, the invention comprises a hydroprocessing process comprising hydroprocessing a hydrocarbon feed in a hydroprocessing reactor to provide hydroprocessing effluent stream. A relatively cold hydroprocessing effluent stream which is a portion of the hydroprocessing effluent stream is stripped in a cold stripper to provide a cold stripped stream. Lastly, a relatively hot hydroprocessing effluent stream which is a portion of the hydroprocessing effluent stream is stripped in a hot stripper to provide a hot stripped stream.

In an additional process embodiment, the invention comprises a hydroprocessing product recovery process for recovering product from a cold hydroprocessing effluent stream and a hot hydroprocessing effluent stream comprising stripping the relatively cold hydroprocessing effluent stream in a cold stripper to provide a cold stripped stream. The relatively hot hydroprocessing effluent stream is stripped in a hot stripper to provide a hot stripped stream. Lastly, the cold stripped stream and the hot stripped stream are fractionated in a product fractionation column to provide product streams.

In a further process embodiment, the invention comprises a stripping process comprising stripping a relatively cold hydroprocessing effluent stream in a cold stripper to provide a cold stripped stream. Lastly, a relatively hot hydroprocessing effluent stream is stripped in a hot stripper to provide a hot stripped stream.

DEFINITIONS

Figure 1:
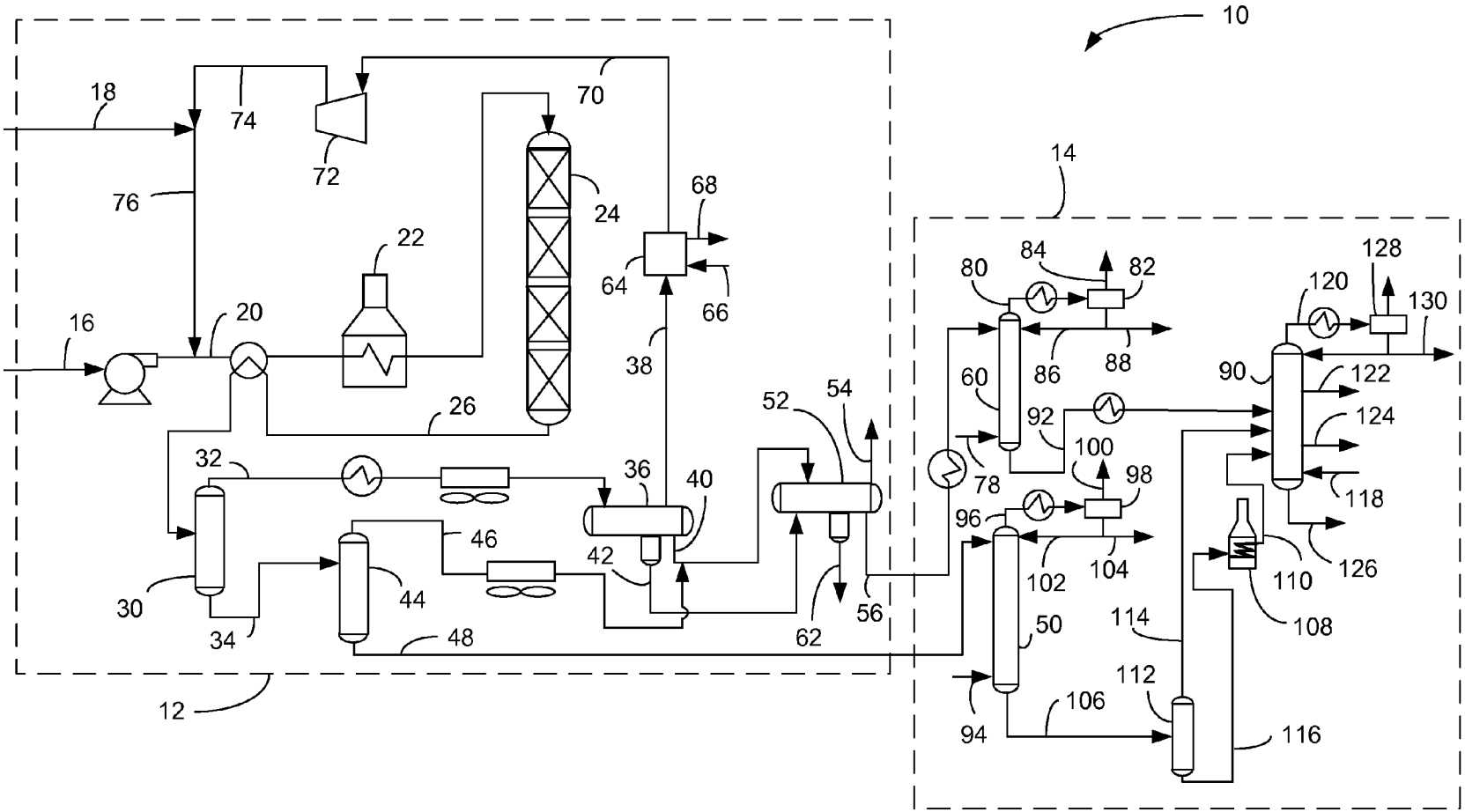
FIG. 1 is a simplified process flow diagram of an embodiment of the present invention.

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. The top pressure is the pressure of the overhead vapor at the vapor outlet of the column. The bottom temperature is the liquid bottom outlet temperature. Overhead lines and bottoms lines refer to the net lines from the column downstream of any reflux or reboil to the column. Stripper columns omit a reboiler at a bottom of the column and instead provide heating requirements and separation impetus from a fluidized inert media such as steam.

As used herein, the term "True Boiling Point" (TBP) means a test method for determining the boiling point of a material which corresponds to ASTM D2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "conversion" means conversion of feed to material that boils at or below the diesel boiling range. The diesel cut point of the diesel boiling range is between about 343° and about 399° C. (650° to 750° F.) using the True Boiling Point distillation method.

As used herein, the term "diesel boiling range" means hydrocarbons boiling in the range of between about 132° and about 399° C. (270° to 750° F.) using the True Boiling Point distillation method.

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator that may be operated at higher pressure.

DETAILED DESCRIPTION

Traditional hydroprocessing design features one stripper which receives two feeds, a relatively cold hydroprocessed effluent stream which may be from a cold flash drum and a relatively hot hydroprocessed effluent stream which may be from a hot flash drum. Although these two feeds contain very different compositions, they can be traced back to the same location from a hydroprocessing reactor and perhaps, a hot separator. An overhead vapor stream of the hot separator may go to a cold separator and the liquid from the cold separator may go to a cold flash drum while a bottoms liquid of the hot separator may go to a hot flash drum. Traditionally, the liquid of both hot and cold flash drums are fed to a single stripper. A stripper bottoms stream may become the feed for the product fractionation column. The inefficiency of this one-stripper design is rooted in mixing of the liquids of the hot flash drum and the cold flash drum in the same stripper which partially undoes the separation previously accomplished in the hot separator and thus requires duplicative heating in a fired heater to the product fractionation column.

Applicants propose to use two strippers, namely a hot stripper which is used for the hot hydroprocessed effluent stream which may be liquid from the hot flash drum and a cold stripper which is used for the cold hydroprocessed effluent stream which may be liquid from the cold flash drum. The cold stripper bottoms does not pass through the product fractionation feed heater but goes directly to the product fractionation column after being heated by less energy-intensive process heat exchange. The hot stripper bottoms may go to the product fractionation feed heater. In this design, the feed rate to the heater is reduced significantly and thus the product fractionation heater duty and size is reduced accordingly. By decreasing the feed rate to the product fractionation feed heater, the fuel used in the heater is decreased approximately 40 percent for a typical hydrocracking unit.

The apparatus and process 10 for hydroprocessing hydrocarbons comprise a hydroprocessing unit 12 and a product recovery unit 14. A hydrocarbon stream in hydrocarbon line 16 and a make-up hydrogen stream in hydrogen make-up line 18 are fed to the hydroprocessing unit 12. Hydroprocessing effluent is fractionated in the product recovery unit 14.

A hydrogen stream in hydrogen line 76 supplemented by make-up hydrogen from line 18 may join the hydrocarbon feed stream in feed line 16 to provide a hydroprocessing feed stream in feed line 20. The hydroprocessing feed stream in line 20 may be heated by heat exchange and in a fired heater 22 and fed to the hydroprocessing reactor 24.

In one aspect, the process and apparatus described herein are particularly useful for hydroprocessing a hydrocarbonaceous feedstock. Illustrative hydrocarbon feedstocks include hydrocarbonaceous streams having components boiling above about 288° C. (550° F.), such as atmospheric gas oils, vacuum gas oil (VGO) boiling between about 315° C. (600° F.) and about 565° C. (1050° F.), deasphalted oil, coker distillates, straight run distillates, pyrolysis-derived oils, high boiling synthetic oils, cycle oils, hydrocracked feeds, catalytic cracker distillates, atmospheric residue boiling at or above about 343° C. (650° F.) and vacuum residue boiling above about 510° C. (950° F.).

Hydroprocessing that occurs in the hydroprocessing unit may be hydrocracking or hydrotreating. Hydrocracking refers to a process in which hydrocarbons crack in the presence of hydrogen to lower molecular weight hydrocarbons. Hydrocracking is the preferred process in the hydroprocessing unit 12. Consequently, the term "hydroprocessing" will include the term "hydrocracking" herein. Hydrocracking also includes slurry hydrocracking in which resid feed is mixed with catalyst and hydrogen to make a slurry and cracked to lower boiling products. VGO in the products may be recycled to manage coke precursors referred to as mesophase.

Hydroprocessing that occurs in the hydroprocessing unit may also be hydrotreating. Hydrotreating is a process wherein hydrogen is contacted with hydrocarbon in the presence of suitable catalysts which are primarily active for the removal of heteroatoms, such as sulfur, nitrogen and metals from the hydrocarbon feedstock. In hydrotreating, hydrocarbons with double and triple bonds may be saturated. Aromatics may also be saturated. Some hydrotreating processes are specifically designed to saturate aromatics. The cloud point of the hydrotreated product may also be reduced.

The hydroprocessing reactor 24 may be a fixed bed reactor that comprises one or more vessels, single or multiple beds of catalyst in each vessel, and various combinations of hydrotreating catalyst and/or hydrocracking catalyst in one or more vessels. It is contemplated that the hydroprocessing reactor 24 be operated in a continuous liquid phase in which the volume of the liquid hydrocarbon feed is greater than the volume of the hydrogen gas. The hydroprocessing reactor 24 may also be operated in a conventional continuous gas phase, a moving bed or a fluidized bed hydroprocessing reactor.

If the hydroprocessing reactor 24 is operated as a hydrocracking reactor, it may provide total conversion of at least about 20 vol-% and typically greater than about 60 vol-% of the hydrocarbon feed to products boiling below the diesel cut point. A hydrocracking reactor may operate at partial conversion of more than about 50 vol-% or full conversion of at least about 90 vol-% of the feed based on total conversion. A hydrocracking reactor may be operated at mild hydrocracking conditions which will provide about 20 to about 60 vol-%, preferably about 20 to about 50 vol-%, total conversion of the hydrocarbon feed to product boiling below the diesel cut point. If the hydroprocessing reactor 24 is operated as a hydrotreating reactor, it may provide conversion per pass of about 10 to about 30 vol-%.

If the hydroprocessing reactor 24 is a hydrocracking reactor, the first vessel or bed in the hydrocracking reactor 24 may include hydrotreating catalyst for the purpose of saturating, demetallizing, desulfurizing or denitrogenating the hydrocarbon feed before it is hydrocracked with hydrocracking catalyst in subsequent vessels or beds in the hydrocracking reactor 24. If the hydrocracking reactor is a mild hydrocracking reactor, it may contain several beds of hydrotreating catalyst followed by a fewer beds of hydrocracking catalyst. If the hydroprocessing reactor 24 is a slurry hydrocracking reactor, it may operate in a continuous liquid phase in an upflow mode and will appear different than in FIG. 1 which depicts a fixed bed reactor. If the hydroprocessing reactor 24 is a hydrotreating reactor it may comprise more than one vessel and multiple beds of hydrotreating catalyst. The hydrotreating reactor may also contain hydrotreating catalyst that is suited for saturating aromatics, hydrodewaxing and hydroisomerization.

A hydrocracking catalyst may utilize amorphous silica-alumina bases or low-level zeolite bases combined with one or more Group VIII or Group VIB metal hydrogenating components if mild hydrocracking is desired to produce a balance of middle distillate and gasoline. In another aspect, when middle distillate is significantly preferred in the converted product over gasoline production, partial or full hydrocracking may be performed in the first hydrocracking reactor 24 with a catalyst which comprises, in general, any crystalline zeolite cracking base upon which is deposited a Group VIII metal hydrogenating component. Additional hydrogenating components may be selected from Group VIB for incorporation with the zeolite base.

The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and about 14 Angstroms ($10^{-10}$ meters). It is preferred to employ zeolites having a relatively high silica/alumina mole ratio between about 3 and about 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8-12 Angstroms ($10^{-10}$ meters), wherein the silica/alumina mole ratio is about 4 to 6. One example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. In one aspect, the preferred cracking bases are those which are at least about 10 percent, and preferably at least about 20 percent, metal-cation-deficient, based on the initial ion-exchange capacity. In another aspect, a desirable and stable class of zeolites is one wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and about 30 percent by weight may be used. In the case of the noble metals, it is normally preferred to use about 0.05 to about 2 wt-%.

The method for incorporating the hydrogenating metal is to contact the base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., about 371° to about 648° C. (about 700° to about 1200° F.) in order to activate the catalyst and decompose ammonium ions. Alternatively, the base component may first be pelleted, followed by the addition of the hydrogenating component and activation by calcining.

The foregoing catalysts may be employed in undiluted form, or the powdered catalyst may be mixed and copelleted with other relatively less active catalysts, diluents or binders such as alumina, silica gel, silica-alumina cogels, activated clays and the like in proportions ranging between about 5 and about 90 wt-%. These diluents may be employed as such or they may contain a minor proportion of an added hydrogenating metal such as a Group VIB and/or Group VIII metal. Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718.

By one approach, the hydrocracking conditions may include a temperature from about 290° C. (550° F.) to about 468° C. (875° F.), preferably 343° C. (650° F.) to about 445° C. (833° F.), a pressure from about 4.8 MPa (gauge) (700 psig) to about 20.7 MPa (gauge) (3000 psig), a liquid hourly space velocity (LHSV) from about 1.0 to less than about 2.5 $hr^{-1}$ and a hydrogen rate of about 421 (2,500 scf/bbl) to about 2,527 $Nm^3/m^3$ oil (15,000 scf/bbl). If mild hydrocracking is desired, conditions may include a temperature from about 315° C. (600° F.) to about 441° C. (825° F.), a pressure from about 5.5 MPa (gauge) (800 psig) to about 13.8 MPa (gauge) (2000 psig) or more typically about 6.9 MPa (gauge) (1000 psig) to about 11.0 MPa (gauge) (1600 psig), a liquid hourly space velocity (LHSV) from about 0.5 to about 2 $hr^{-1}$ and preferably about 0.7 to about 1.5 $hr^{-1}$ and a hydrogen rate of about 421 $Nm^3/m^3$ oil (2,500 scf/bbl) to about 1,685 $Nm^3/m^3$ oil (10,000 scf/bbl).

Slurry hydrocracking catalyst are typically ferrous sulfate hydrates having particle sizes less than 45 μm and with a major portion, i.e. at least 50% by weight, in an aspect, having particle sizes of less than 10 μm. Iron sulfate monohydrate is a suitable catalyst. Bauxite catalyst may also be suitable. In an aspect, 0.01 to 4.0 wt-% of catalyst based on fresh feedstock are added to the hydrocarbon feed. Oil soluble catalysts may be used alternatively or additionally. Oil soluble catalysts include metal naphthenate or metal octanoate, in the range of 50-1000 wppm based on fresh feedstock. The metal may be molybdenum, tungsten, ruthenium, nickel, cobalt or iron.

A slurry hydrocracking reactor may be operated at a pressure, in an aspect, in the range of 3.5 MPa (gauge) (508 psig) to 24 MPa (gauge) (3,481 psig), without coke formation in the reactor. The reactor temperature may be in the range of about 350° to 600° C. with a temperature of about 400° to 500° C. being typical. The LHSV is typically below about 4 $h^{-1}$ on a fresh feed basis, with a range of about 0.1 to 3 $hr^{-1}$ being suitable and a range of about 0.2 to 1 $hr^{-1}$ being particularly suitable. The per-pass pitch conversion may be between 50 and 95 wt-%. The hydrogen feed rate may be about 674 to about 3370 $Nm^3/m^3$ (4000 to about 20,000 SCF/bbl) oil. An antifoaming agent may also be added to the slurry hydrocracking reactor 24, in an aspect, to the top thereof, to reduce the tendency to generate foam.

Suitable hydrotreating catalysts for use in the present invention are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts, as well as noble metal catalysts where the noble metal is selected from palladium and platinum. It is within the scope of the present invention that more than one type of hydrotreating catalyst be used in the same hydrotreating reactor 96. The Group VIII metal is typically present in an amount ranging from about 2 to about 20 wt-%, preferably from about 4 to about 12 wt-%. The Group VI metal will typically be present in an amount ranging from about 1 to about 25 wt-%, preferably from about 2 to about 25 wt-%.

Preferred hydrotreating reaction conditions include a temperature from about 290° C. (550° F.) to about 455° C. (850° F.), suitably 316° C. (600° F.) to about 427° C. (800° F.) and preferably 343° C. (650° F.) to about 399° C. (750° F.), a pressure from about 2.1 MPa (gauge) (300 psig), preferably 4.1 MPa (gauge) (600 psig) to about 20.6 MPa (gauge) (3000 psig), suitably 12.4 MPa (gauge) (1800 psig), preferably 6.9 MPa (gauge) (1000 psig), a liquid hourly space velocity of the fresh hydrocarbonaceous feedstock from about 0.1 $hr^{-1}$, suitably 0.5 $hr^{-1}$, to about 4 $hr^{-1}$, preferably from about 1.5 to about 3.5 $hr^{-1}$, and a hydrogen rate of about 168 $Nm^3/m^3$ (1,000 scf/bbl), to about 1,011 $Nm^3/m^3$ oil (6,000 scf/bbl), preferably about 168 $Nm^3/m^3$ oil (1,000 scf/bbl) to about 674 $Nm^3/m^3$ oil (4,000 scf/bbl), with a hydrotreating catalyst or a combination of hydrotreating catalysts.

A hydroprocessing effluent exits the hydroprocessing reactor 24 and is transported in hydroprocessing effluent line 26. The hydroprocessing effluent comprises material that will become a relatively cold hydroprocessing effluent stream and a relatively hot hydroprocessing effluent stream. The hydroprocessing unit may comprise one or more separators for separating the hydroprocessing effluent stream into a cold hydroprocessing effluent stream and hot hydroprocessing effluent stream.

The hydroprocessing effluent in hydroprocessing effluent line 26 may in an aspect be heat exchanged with the hydroprocessing feed stream in line 20 to be cooled before entering a hot separator 30. The hot separator separates the hydroprocessing effluent to provide a vaporous hydrocarbonaceous hot separator overhead stream in an overhead line 32 comprising a portion of a cold hydroprocessed effluent stream and a liquid hydrocarbonaceous hot separator bottoms stream in a bottoms line 34 comprising a portion of a cold hydroprocessed effluent stream and still a portion of a hot hydroprocessed effluent stream. The hot separator 30 in the hydroprocessing section 12 is in downstream communication with the hydroprocessing reactor 24. The hot separator 30 operates at about 177° C. (350° F.) to about 371° C. (700° F.) and preferably operates at about 232° C. (450° F.) to about 315° C. (600° F.). The hot separator 30 may be operated at a slightly lower pressure than the hydroprocessing reactor 24 accounting for pressure drop of intervening equipment. The hot separator may be operated at pressures between about 3.4 MPa (gauge) (493 psig) and about 20.4 MPa (gauge) (2959 psig).

The vaporous hydrocarbonaceous hot separator overhead stream in the overhead line 32 may be cooled before entering a cold separator 36. As a consequence of the reactions taking place in the hydroprocessing reactor 24 wherein nitrogen, chlorine and sulfur are removed from the feed, ammonia and hydrogen sulfide are formed. At a characteristic temperature, ammonia and hydrogen sulfide will combine to form ammonium bisulfide and ammonia and chlorine will combine to form ammonium chloride. Each compound has a characteristic sublimation temperature that may allow the compound to coat equipment, particularly heat exchange equipment, impairing its performance. To prevent such deposition of ammonium bisulfide or ammonium chloride salts in the line 32 transporting the hot separator overhead stream, a suitable amount of wash water (not shown) may be introduced into line 32 upstream at a point in line 32 where the temperature is above the characteristic sublimation temperature of either compound.

The cold separator 36 serves to separate hydrogen from hydrocarbon in the hydroprocessing effluent for recycle to the hydroprocessing reactor 24 in the overhead line 38. The vaporous hydrocarbonaceous hot separator overhead stream may be separated in the cold separator 36 to provide a vaporous cold separator overhead stream comprising a hydrogen-rich gas stream in an overhead line 38 and a liquid cold separator bottoms stream in the bottoms line 40 comprising a portion of the cold hydroprocessing effluent stream. The cold separator 36, therefore, is in downstream communication with the overhead line 32 of the hot separator 30 and the hydroprocessing reactor 24. The cold separator 36 may be operated at about 100° F. (38° C.) to about 150° F. (66° C.), suitably about 115° F. (46° C.) to about 145° F. (63° C.), and just below the pressure of the hydroprocessing reactor 24 and the hot separator 30 accounting for pressure drop of intervening equipment to keep hydrogen and light gases in the overhead and normally liquid hydrocarbons in the bottoms. The cold separator may be operated at pressures between about 3 MPa (gauge) (435 psig) and about 20 MPa (gauge) (2,901 psig). The cold separator 36 may also have a boot for collecting an aqueous phase in line 42.

The liquid hydrocarbonaceous stream in the hot separator bottoms line 34 may be fractionated as hot hydroprocessing effluent stream in the product recovery unit 14. In an aspect, the liquid hydrocarbonaceous stream in the bottoms line 34 may be let down in pressure and flashed in a hot flash drum 44 to provide a hot flash overhead stream of light ends in an overhead line 46 comprising a portion of the cold hydroprocessed effluent stream and a heavy liquid stream in a bottoms line 48 comprising at least a portion of the hot hydroprocessed effluent stream. The hot flash drum 44 may be any separator that splits the liquid hydroprocessing effluent into vapor and liquid fractions. The hot flash drum 44 may be operated at the same temperature as the hot separator 30 but at a lower pressure of between about 2.1 MPa (gauge) (300 psig) and about 6.9 MPa (gauge) (1000 psig), suitably less than about 3.4 MPa (gauge) (500 psig). The heavy liquid stream in bottoms line 48 may be further fractionated in the product recovery unit 14. In an aspect, the heavy liquid stream in bottoms line 48 may be introduced into a hot stripper 50 and comprise at least a portion, and suitably all, of a relatively hot hydroprocessing effluent stream. The hot stripper 50 is in downstream communication with a bottom of the hot flash drum 44 via bottoms line 48.

In an aspect, the liquid hydroprocessing effluent stream in the cold separator bottoms line 40 may be fractionated as a cold hydroprocessing effluent stream in the product recovery unit 14. In a further aspect, the cold separator liquid bottoms stream may be let down in pressure and flashed in a cold flash drum 52 to separate the cold separator liquid bottoms stream in bottoms line 40. The cold flash drum 52 may be any separator that splits hydroprocessing effluent into vapor and liquid fractions. The cold flash drum may be in communication with a bottom of the cold separator 36 via bottoms line 40. A cold stripper 60 may be in downstream communication with a bottoms line 56 of the cold flash drum 52.

In a further aspect, the vaporous hot flash overhead stream in overhead line 46 may be fractionated as a cold hydroprocessing effluent stream in the product recovery unit 14. In a further aspect, the hot flash overhead stream may be cooled and also separated in the cold flash drum 52. The cold flash drum 52 may separate the cold separator liquid bottoms stream in line 40 and hot flash vaporous overhead stream in overhead line 46 to provide a cold flash overhead stream in overhead line 54 and a cold flash bottoms stream in a bottoms line 56 comprising at least a portion of a cold hydroprocessed effluent stream. The cold flash bottoms stream in bottoms line 56 comprises at least a portion, and suitably all, of the cold hydroprocessed effluent stream. In an aspect, the cold stripper 60 is in downstream communication with the cold flash drum 52 via bottoms line 56. The cold flash drum 52 may be in downstream communication with the bottoms line 40 of the cold separator 50, the overhead line 46 of the hot flash drum 44 and the hydroprocessing reactor 24. The cold separator bottoms stream in bottoms line 40 and the hot flash overhead stream in overhead line 46 may enter into the cold flash drum 52 either together or separately. In an aspect, the hot flash overhead line 46 joins the cold separator bottoms line 40 and feeds the hot flash overhead stream and the cold separator bottoms stream together to the cold flash drum 52. The cold flash drum 52 may be operated at the same temperature as the cold separator 50 but typically at a lower pressure of between about 2.1 MPa (gauge) (300 psig) and about 7.0 MPa (gauge) (1000 psig) and preferably no higher than 3.1 MPa (gauge) (450 psig). The aqueous stream in line 42 from the boot of the cold separator may also be directed to the cold flash drum 52. A flashed aqueous stream is removed from a boot in the cold flash drum 52 in line 62.

The vaporous cold separator overhead stream comprising hydrogen in the overhead line 38 is rich in hydrogen. The cold separator overhead stream in overhead line 38 may be passed through a trayed or packed scrubbing tower 64 where it is scrubbed by means of a scrubbing liquid such as an aqueous amine solution in line 66 to remove hydrogen sulfide and ammonia. The spent scrubbing liquid in line 68 may be regenerated and recycled back to the scrubbing tower 64. The scrubbed hydrogen-rich stream emerges from the scrubber via line 70 and may be compressed in a recycle compressor 72 to provide a recycle hydrogen stream in line 74 which is a compressed vaporous hydroprocessing effluent stream. The recycle compressor 72 may be in downstream communication with the hydroprocessing reactor 24. The recycle hydrogen stream in line 74 may be supplemented with make-up stream 18 to provide the hydrogen stream in hydrogen line 76. A portion of the material in line 74 may be routed to the intermediate catalyst bed outlets in the hydroprocessing reactor 24 to control the inlet temperature of the subsequent catalyst bed (not shown).

The product recovery section 14 may include a hot stripper 50, a cold stripper 60 and a product fractionation column 90. The cold stripper 60 is in downstream communication with the hydroprocessing reactor 24 for stripping the relatively cold hydroprocessing effluent stream which is a portion of the hydroprocessing effluent stream in hydroprocessing effluent line 26, and the hot stripper is in downstream communication with the hydroprocessing reactor 24 for stripping the relatively hot hydroprocessing effluent stream which is also a portion of the hydroprocessing effluent stream in hydroprocessing effluent line 26. In an aspect, the cold hydroprocessing effluent stream is the cold flash bottoms stream in bottoms line 56 and the hot hydroprocessing effluent stream is the hot flash bottoms stream in bottoms line 48, but other sources of these streams are contemplated.

The cold hydroprocessing effluent stream which in an aspect may be in the cold flash bottoms line 56 may be heated and fed to the cold stripper column 60 near the top of the column. The cold hydroprocessing effluent stream which comprises at least a portion of the liquid hydroprocessing effluent may be stripped in the cold stripper column 60 with a cold stripping media which is an inert gas such as steam from a cold stripping media line 78 to provide a cold vapor stream of naphtha, hydrogen, hydrogen sulfide, steam and other gases in an overhead line 80. At least a portion of the cold vapor stream may be condensed and separated in a receiver 82. An overhead line 84 from the receiver 82 carries vaporous off gas for further treating. Unstabilized liquid naphtha from the bottoms of the receiver 82 may be split between a reflux portion in line 86 refluxed to the top of the cold stripper column 60 and a product portion which may be transported in product line 88 to further fractionation such as in a debutanizer or a deethanizer column (not shown). The cold stripper column 60 may be operated with a bottoms temperature between about 149° C. (300° F.) and about 260° C. (500° F.) and an overhead pressure of about 0.5 MPa (gauge) (73 psig) to about 2.0 MPa (gauge) (290 psig). The temperature in the overhead receiver 82 ranges from about 38° C. (100° F.) to about 66° C. (150° F.) and the pressure is essentially the same as in the overhead of the cold stripper column 60.

A hydrocracked cold stripped stream in bottoms line 92 may be heated with a process heater that is less intensive than a fired heater and fed to the product fractionation column 90. Consequently, the product fractionation column 90 is in downstream communication with the bottoms line 92 of the cold stripper. The cold stripped stream may be heat exchanged with a bottoms stream in bottoms line 126 from the product fractionation column 90 or other suitable stream before entering the product fractionation column 90.

The hot hydroprocessing effluent stream which may be in the hot flash bottoms line 48 may be fed to the hot stripper column 50 near the top thereof. The hot hydroprocessing effluent stream which comprises at least a portion of the liquid hydroprocessing effluent may be stripped in the hot stripper column 50 with a hot stripping media which is an inert gas such as steam from line 94 to provide a hot vapor stream of naphtha, hydrogen, hydrogen sulfide, steam and other gases in an overhead line 96. At least a portion of the hot vapor stream may be condensed and separated in a receiver 98. An overhead line 100 from the receiver 98 carries vaporous off gas for further treating. Unstabilized liquid naphtha from the bottoms of the receiver 98 may be split between a reflux portion in line 102 refluxed to the top of the hot stripper column 50 and a product portion which may be transported in product line 104 to further fractionation such as to a debutanizer column or a deethanizer column (not shown). It is also contemplated that the product portion from the hot stripper column 50 in line 104 be fed to the cold stripper column 60. The hot stripper column 50 may be operated with a bottoms temperature between about 160° C. (320° F.) and about 360° C. (680° F.) and an overhead pressure of about 0.5 MPa (gauge) (73 psig) to about 2.0 MPa (gauge) (292 psig). The temperature in the overhead receiver 98 ranges from about 38° C. (100° F.) to about 66° C. (150° F.) and the pressure is essentially the same as in the overhead of the hot stripper column 50.

A hydroprocessed hot stripped stream is produced in bottoms line 106. At least a portion of the hot stripped stream in bottoms line 106 may be fed to the product fractionation column 90. Consequently, the product fractionation column 90 is in downstream communication with the bottoms line 106 of the hot stripper.

A fired heater 108 in downstream communication with the hot bottoms line 106 may heat at least a portion of the hot stripped stream before it enters the product fractionation column 90 in line 110. The cold stripped stream in line 92 can be added to the product fractionation column 90 at a location that does not require heating in the fired heater 108. The cold bottoms line 92 carrying the cold stripped stream to the product fractionation column 90 may bypass the fired heater 108. A cold inlet for the cold stripped stream in line 92 to the product fractionation column 90 is at a higher elevation than a hot inlet for the hot stripped stream in line 110 to the product fractionation column 90.

In an aspect, the hot stripped stream in hot bottoms line 106 may be separated in a separator 112. A vaporous hot stripped stream in overhead line 114 from the separator 112 may be passed into the product fractionation column 90 at an inlet lower than or at the same elevation as the cold inlet for the cold stripped stream in line 92. A liquid hot stripped stream in bottoms line 116 may be the portion of the hot stripped stream that is fed to the product fractionation column 90 after heating in the fired heater 108 to be a fired hot stripped stream in line 110. The fired hot stripped stream in line 110 may be introduced into the product fractionation column 90 at an elevation lower than the cold inlet for the cold stripped stream in line 92 and the inlet for the vapor stream in line 114.

The product fractionation column 90 may be in communication with the cold stripper column 60 and the hot stripper 50 for separating stripped streams into product streams. The product fractionation column 90 may also strip the cold stripped stream in line 92 and the hot stripped stream in line 106, which may be the vaporous hot stripped stream in line 114 and the liquid hot stripped stream in line 116 or the fired hot stripped stream in line 110, with stripping media such as steam from line 118 to provide several product streams. The product streams may include an overhead naphtha stream in overhead line 120, a kerosene stream in line 122 from a side cut outlet, a diesel stream carried in line 124 from a side cut outlet and an unconverted oil stream in a bottoms line 126 which may be suitable for further processing, such as in an FCC unit. Heat may be removed from the product fractionation column 90 by cooling the kerosene in line 122 and diesel in line 124 and sending a portion of each cooled stream back to the column. The overhead naphtha stream in line 120 may be condensed and separated in a receiver 128 with liquid being refluxed back to the product fractionation column 90. The net naphtha stream in line 130 may require further processing such as in a naphtha splitter column before blending in the gasoline pool. The product fractionation column 90 may be operated with a bottoms temperature between about 288° C. (550° F.) and about 370° C. (700° F.), preferably about 343° C. (650° F.) and at an overhead pressure between about 30 kPa (gauge) (4 psig) to about 200 kPa (gauge) (29 psig). A portion of the unconverted oil in the bottoms line 126 may be reboiled and returned to the product fractionation column 90 instead of using steam stripping.

Sour water streams may be collected from boots (not shown) of overhead receivers 82, 98 and 128.

Figure 2:
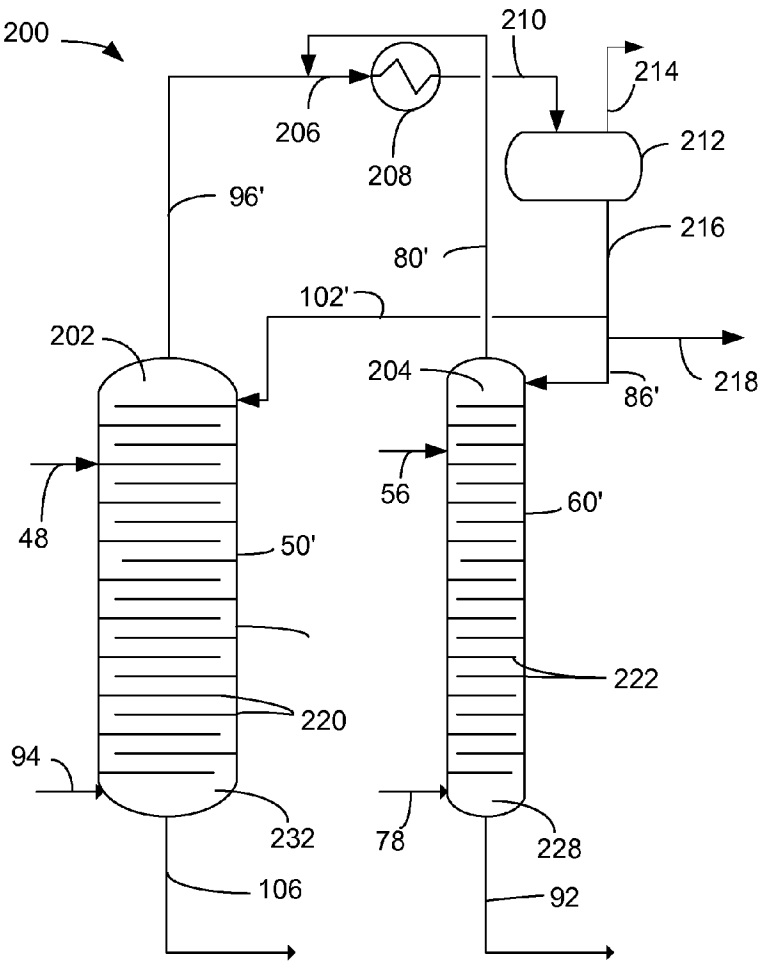
FIG. 2 is a simplified process flow diagram of an alternative embodiment of the strippers of FIG. 1.

In the embodiment of FIG. 1, the overhead recovery for each of the strippers 50 and 60 are separate. We have found that the overhead vapor from each of the strippers 50 and 60 are very similar in composition, temperature and pressure. FIG. 2 illustrates an embodiment of the hot stripper column 50 and the cold stripper column 60 share a common overhead recovery apparatus 200. Many of the elements in FIG. 2 have the same configuration as in FIG. 1 and bear the same respective reference number. Elements in FIG. 2 that correspond to elements in FIG. 1 but have a different configuration bear the same reference numeral as in FIG. 1 but are marked with a prime symbol (').

In FIG. 2, hot hydroprocessing effluent in line 48 feeds a hot stripper column 50' and a cold hydroprocessing effluent in line 56 feeds a cold stripper column 60' as in FIG. 1. A cold stripping media line 78 to the cold stripper column 60' supplies cold stripping media to the cold stripper column 60' and a hot stripping media line 94 to the hot stripping column 50' supplies hot stripping media to the hot stripper column 50'. Stripping media is typically medium pressure steam and the label of hot and cold with respect to stripping media does not indicate relative temperature. Trays 220 in the hot stripper column 50' and trays 222 in the cold stripper column 60' or other packing materials enhance vapor liquid contacting and stripping. A cold stripped stream is produced in bottoms line 92 and a hot stripped stream is produced in bottoms line 106. A cold stripper bottoms section 228 is isolated from the hot stripper bottoms section 232 of the hot stripper to isolate the cold stripped stream in bottoms line 92 from the hot stripped stream in hot bottoms line 106. The cold stripped bottoms line 92 of the cold stripper column 60' is isolated from a hot stripped bottoms line 106 of the hot stripper column 50' to further isolate a cold stripped bottoms stream from a hot stripped bottoms stream.

An overhead line 80' carrying a cold vapor stream from an overhead section 204 of a cold stripper 60' and an overhead line 96' carrying a hot vapor stream from an overhead section 202 of a hot stripper 50' both feed a common overhead condenser 208 for condensing the cold vapor stream and the hot vapor stream to provide a condensed overhead stream in condensate line 210. The condenser 208 is in downstream communication with the overhead section 204 and the overhead line 80' of the cold stripper and overhead section 202 and the overhead line 96' of the hot stripper 50'. The cold vapor stream in overhead line 80' and the hot vapor stream in overhead line 96' may be mixed in a joined line 206 before entering the condenser 208. Condensate line 210 may transport the condensed overhead stream to a common overhead receiver 212 in downstream communication with the overhead line 80' of the cold stripper 60 and the overhead line 96' of the hot stripper 50'. In the overhead receiver 212, the condensed overhead stream is separated into an off-gas stream in an overhead line 214 for further processing and a condensed receiver bottoms stream in bottoms line 216. A sour water stream may be recovered from a boot (not shown) in receiver 212. The common overhead receiver 212 is operated in the same temperature and pressure ranges as the individual cold overhead receiver 82 and hot overhead receiver 98.

The condensed receiver bottom stream in bottoms line 216 may be split into three portions. At least a first portion of the condensed receiver bottoms stream in line 216 may be refluxed to a top of the hot stripper 50' in a hot reflux line 102'. The hot reflux line 102' may be in downstream communication with the bottoms line 216 of the overhead receiver 212 and the hot stripper 50' may be in downstream communication with the hot reflux line 102'.

At least a second portion of the condensed receiver bottoms stream in line 216 may be refluxed to a top of the cold stripper 60' in a cold reflux line 86'. The cold reflux line 86' may be in downstream communication with the bottoms line 216 of the overhead receiver 212 and the cold stripper 60' may be in downstream communication with the cold reflux line 86'. The flow rate of cold reflux in line 86' and hot reflux in line 102' must be regulated to ensure each stripper column 50' and 60' receives sufficient reflux to provide sufficient liquid to the respective columns.

A third portion of the condensed receiver bottoms in line 216 comprising unstabilized naphtha may be transported in line 218 to a fractionation column (not shown) for further processing.

The embodiment of FIG. 2 reduces capital equipment for the overhead recovery apparatus 200 in half by using only one condenser, receiver and associated piping instead of two.

The rest of the embodiment in FIG. 2 may be the same as described for FIG. 1 with the previous noted exceptions.

Figure 3:
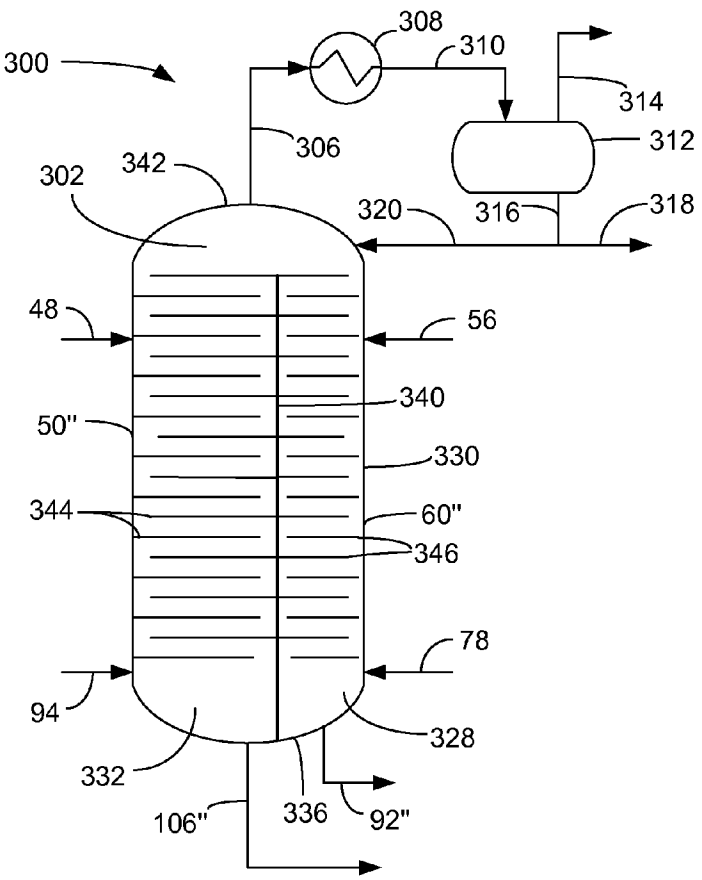
FIG. 3 is a simplified process flow diagram of an additional alternative embodiment of the strippers of FIG. 1.

In the embodiment of FIG. 2, the overhead section for each of the stripper columns 50' and 60' were kept separate. FIG. 3 illustrates an embodiment of a hot stripper section 50" and a cold stripper section 60" sharing a common overhead section 302. Many of the elements in FIG. 3 have the same configuration as in FIG. 1 and bear the same respective reference number. Elements in FIG. 3 that correspond to elements in FIG. 1 but have a different configuration bear the same reference numeral as in FIG. 1 but are marked with a double prime symbol (").

In the embodiment of FIG. 3, a cold stripper section 60" and a hot stripper section 50" are contained in the same stripping vessel 330 and share the same overhead section 302. The cold stripper section 60" and the hot stripper section 50" are adjacent to each other in the stripping vessel 330.

The heavier material in the hot hydroprocessing effluent in line 48 fed to the hot stripper section 50" has a different composition than the cold hydroprocessed effluent 56 fed to the cold stripper section 60". For example, the hot hydroprocessed effluent 48 may have more sulfur compounds and be hotter than the cold hydroprocessed effluent 56. To maintain the beneficial effect of the invention, a barrier 340 prevents vapor and liquid material in the hot stripper section 50" from entering into the cold stripper section 60".

The barrier 340 in FIG. 3 may comprise a vertical wall. The barrier 340 may extend all the way to a bottom 336 of the vessel 330 and be coextensive with a bottom section 328 of the cold stripper section 60". A top of the barrier 340 is spaced apart from a top 342 of the stripping vessel 330 to allow the overhead cold vapor from the cold stripper section 60" to mix with the hot vapor from the hot stripper section 50" in the common overhead section 302. No material from the hot stripper section 50" passes to the cold stripper section 60" below a top of the barrier 340 in the stripping vessel 330. The cold stripper bottoms section 328 is isolated from the hot stripper bottoms section 332 of the hot stripper to isolate the cold stripped stream in bottoms line 92" from the hot stripped stream in bottoms line 106".

Hot hydroprocessing effluent in line 48 feeds the hot stripper section 50" and a cold hydroprocessing effluent in line 56 feeds a cold stripper section 60" on opposite sides of the barrier 340. A cold stripping media line 78 to the cold stripper section 60" supplies stripping media to the cold stripper section 60" and a hot stripping media line 94 to the hot stripping section 50" supplies stripping media to the hot stripper section 50". Stripping media is typically medium pressure steam and the label of hot and cold with respect to stripping media does not indicate relative temperature. Trays 344 in the hot stripper section 50" and trays 346 in the cold stripper section 60" or other packing materials enhance vapor liquid contacting and stripping. A cold stripped bottoms line 92" may extend from the bottom section 328 of the cold stripper section 60" for withdrawing a cold stripped stream through a bottom 336 of the cold stripper 60". A hot stripped bottoms line 106" may extend from a bottom section 332 of the hot stripper section 50" for withdrawing a hot stripped stream through a bottom 336 of the hot stripper 50". A cold stripped stream is produced in bottoms line 92" and a hot stripped stream is produced in bottoms line 106".

A common overhead apparatus 300 services vapor from the common overhead section 302 of the hot stripper section 50" and the cold stripper section 60". The hot vapor stream from the hot stripper section 50" and the cold vapor stream from the cold stripper section 60" mix in the common overhead section 302. An overhead line 306 from the common overhead section 302 of the cold stripper 60" and the hot stripper 50" both feed a common overhead condenser 308 for condensing the mixed cold vapor stream and hot vapor stream together to provide a condensed overhead stream in condensate line 310. The condenser 308 is in downstream communication with the overhead section 302 and the overhead line 306 of the cold stripper and the hot stripper 50'. Condensate line 310 may transport the condensed overhead stream to a common overhead receiver 312 in downstream communication with the overhead line 306 of the cold stripper 60" and the hot stripper 50". In the overhead receiver 312, the condensed overhead stream is separated into an off-gas stream in an overhead line 314 for further processing and a condensed receiver bottoms stream in bottoms line 316.

The condensed receiver bottom stream in bottoms line 316 may be split into two portions. At least a first portion of the condensed receiver bottoms stream in line 316 may be refluxed to the common overhead section 302 at a top of the hot stripper 50" and the cold stripper 60" in an aspect above the barrier 340 in a common reflux line 320. A second portion of the condensed receiver bottoms stream in line 316 comprising unstabilized naphtha may be transported in line 318 to a fractionation column (not shown) for further processing. A sour water stream may be recovered from a boot (not shown) in receiver 312.

The rest of the embodiment in FIG. 3 may be the same as described for FIG. 1 with the previous noted exceptions. The adjacent strippers in the same vessel 330 require only one vessel and one foot print for a single stripper vessel 330 instead of two vessels.

Figure 4:
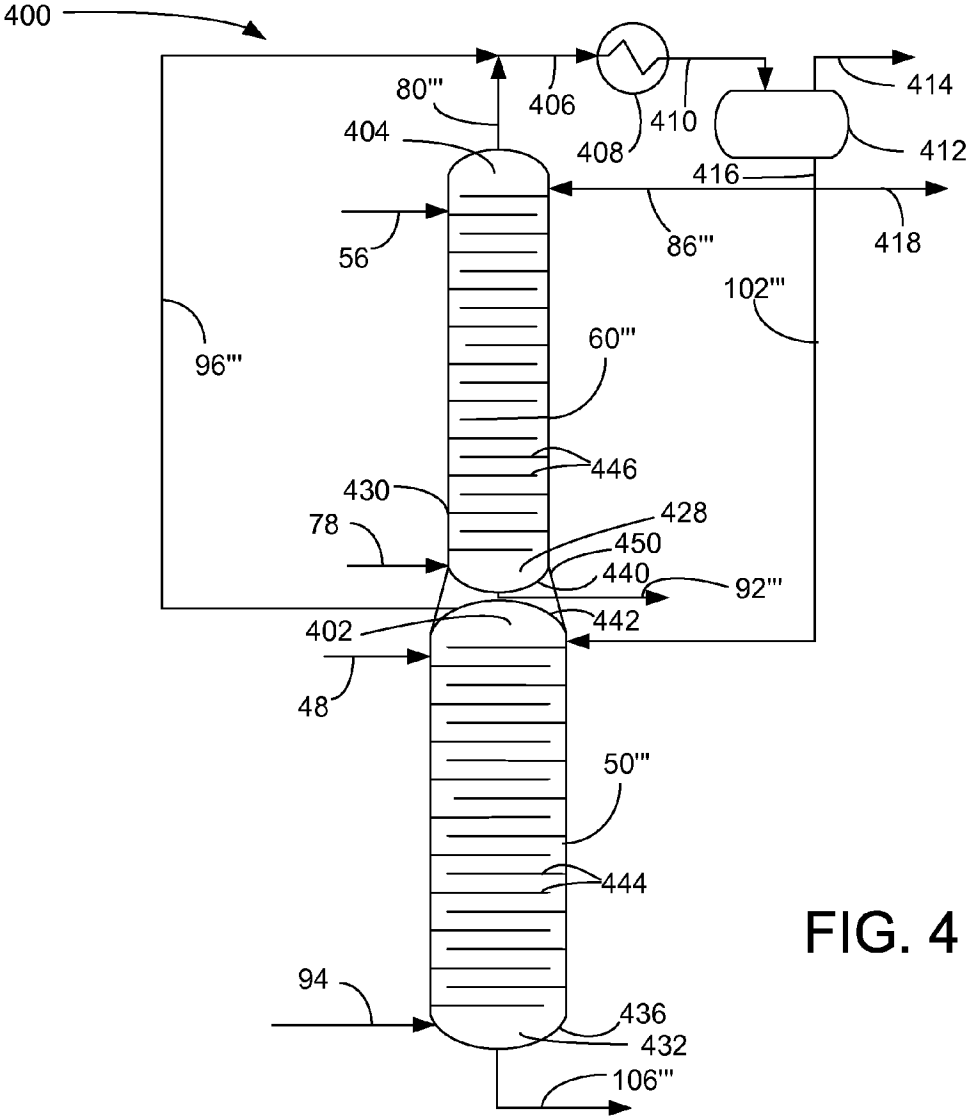
FIG. 4 is a simplified process flow diagram of a further alternative embodiment of the strippers of FIG. 1.

In the embodiment of FIG. 3, the hot stripper section 50" and the cold stripper section 60" are adjacent to each other in the same vessel 300 and share a common overhead section 302. FIG. 4 illustrates an embodiment of a hot stripper section 50''' and a cold stripper section 60''' contained in the same vessel, but stacked on top of each other and using separate overhead sections 402, 404 but with a common overhead recovery apparatus 400. Many of the elements in FIG. 4 have the same configuration as in FIGS. 1, 2 and 3 and bear the same respective reference number. Elements in FIG. 4 that correspond to elements in FIG. 1 but have a different configuration bear the same reference numeral as in FIG. 1 but are marked with a double prime symbol (''').

In the embodiment of FIG. 4, a cold stripper section 60''' and a hot stripper section 50''' are contained in the same stripping vessel 430 but do not share the same overhead sections 402, 404 or bottoms sections 432, 428. The cold stripper section 60''' and the hot stripper section 50''' are stacked on top of each other in the stripping vessel 400, in an aspect with the cold stripper section 60''' on top of the hot stripper section 50'''.

The heavier material in the hot hydroprocessing effluent in line 48 fed to the hot stripper section 50''' has a different composition than the cold hydroprocessed effluent 56 fed to the cold stripper section 60'''. For example, the hot hydroprocessed effluent 48 may have more sulfur compounds and be hotter than the cold hydroprocessed effluent 56. To maintain the beneficial effect of the invention, a barrier 440 prevents material, vapor and liquid, in the hot stripper section 50''' from entering with unwanted sulfur compounds into the cold stripper section 60'''. The barrier 440 particularly prevents hydrogen sulfide in the vapor from the overhead section 402 of the hot stripper 50''' from entering into a cold stripped stream in bottoms line 92'''.

The barrier 440 in FIG. 4 may comprise a hemispherical wall or head. The barrier 440 may extend across the entire cross section of a bottom section 428 of the cold stripper section 60'''. The barrier may include a hemispherical wall 442 or head extending across the entire cross section of the overhead 402 of the hot stripper section 50''' instead of or in addition to the barrier 440. The barrier 440 prevents the overhead hot vapor or other material from the hot stripper section 50'' from mixing with the cold vapor or other material from the cold stripper section 60'''. No material from the hot stripper section 50''' passes to the cold stripper section 60''' and vice versa. The cold stripper bottoms section 428 is isolated from the hot stripper bottoms section 432 of the hot stripper to isolate the cold stripped stream in bottoms line 92''' from the hot stripped stream in bottoms line 106'''. Moreover, the cold stripper bottom section 428 is isolated from the hot stripper overhead section 402 to prevent hydrogen sulfide from the hot stripper overhead section 402 from entering into the cold stripped stream in cold bottoms line 92'''.

Hot hydroprocessing effluent in line 48 feeds the hot stripper section 50''' and a cold hydroprocessing effluent in line 56 feeds a cold stripper section 60''' on opposite sides of the barrier 440. A cold stripping media line 78 to the cold stripper section 60''' supplies stripping media to the cold stripper section 60''' and a hot stripping media line 94 to the hot stripping section 50''' supplies stripping media to the hot stripper section 50'''. Stripping media is typically medium pressure steam and the label of hot and cold with respect to stripping media does not indicate relative temperature. Trays 444 in the hot stripper section 50'' and trays 446 in the cold stripper section 60''' or other packing materials enhance vapor liquid contacting and stripping. A cold stripped bottoms line 92''' may extend from the bottom section 428 of the cold stripper section 60''' for withdrawing a cold stripped stream through the barrier 440 which may be at the bottom of the cold stripper section 60'''. The cold stripped bottoms line 92''' may extend through the barrier 440 and a wall 450 of the stripping vessel 430 for withdrawing the cold stripped stream through the wall 450 in the stripping vessel 400.

A hot stripped bottoms line 106''' may extend from a bottom section 432 of the hot stripper section 50''' for withdrawing a hot stripped stream through a bottom 436 of the hot stripper 50'''. A cold stripped stream is produced in bottoms line 92''' and a hot stripped stream is produced in bottoms line 106'''.

An overhead line 80''' from an overhead section 404 of a cold stripper section 60''' and an overhead line 96''' from an overhead section 402 of a hot stripper section 50''' both feed a common overhead condenser 408 for condensing the cold vapor stream and the hot vapor stream to provide a condensed overhead stream in condensate line 410. It is also contemplated that a separate overhead recovery apparatus can be used for each overhead line 80''' and 96''' as in FIG. 1. The condenser 408 is in downstream communication with the overhead section 404 and the overhead line 80''' of the cold stripper section 60''' and overhead section 402 and the overhead line 96''' of the hot stripper section 50'''. The cold vapor stream in overhead line 80''' and the hot vapor stream in overhead line 96''' may be mixed in a joined line 406 before entering the condenser 408. Condensate line 410 may transport the condensed overhead stream to a common overhead receiver 412 in communication with the overhead line 80''' of the cold stripper section 60''' and the overhead line 96''' of the hot stripper section 50'''. In the overhead receiver 412, the condensed overhead stream is separated into an off-gas stream in an overhead line 414 for further processing and a condensed receiver bottoms stream in bottoms line 416. A sour water stream may also be collected from a boot (not shown) of the overhead receiver 412.

The condensed receiver bottom stream in bottoms line 416 may be split into three portions. At least a first portion of the condensed receiver bottoms stream in line 416 may be refluxed to a top of the hot stripper section 50''' in a hot reflux line 102'''. The hot reflux line 102''' may be in downstream communication with the bottoms line 416 of the overhead receiver 412, and the hot stripper section 50''' may be in downstream communication with the hot reflux line 102'''.

At least a second portion of the condensed receiver bottoms stream in line 416 may be refluxed to a top of the cold stripper section 60''' in a cold reflux line 86'''. The cold reflux line 86''' may be in downstream communication with the bottoms line 416 of the overhead receiver 412, and the cold stripper section 60''' may be in downstream communication with the cold reflux line 86'''. The flow rate of cold reflux in line 86''' and hot reflux in line 102''' must be regulated to ensure each stripper section 50''' and 60''' receives sufficient reflux to provide sufficient liquid to the respective columns.

A third portion of the condensed receiver bottoms in line 416 comprising unstabilized naphtha may be transported in line 418 to a fractionation column (not shown) for further processing.

The rest of the embodiment in FIG. 4 may be the same as described for FIGS. 1, 2 and 3 with the previous noted exceptions. The stacked strippers require only one vessel and one foot print for a single stripper vessel 430 instead of two vessels.

EXAMPLE

The present invention which utilizes a hot stripper and a cold stripper instead of a single stripper counter-intuitively saves capital and operating expense. The cold stripped stream does not pass through the product fractionation feed heater but goes to the product fractionation column after being heated by process exchange. Only the hot stripped stream in the bottoms line goes to the product fractionation feed heater thus reducing the feed rate to the heater significantly and thereby reducing the product fractionation feed heater duty and size accordingly.

We calculate for a hydroprocessing unit that hydroprocesses 10.5 megaliters (66,000 bbl) of feed per day, the decrease in feed rate to the product fractionation feed heater provided by the invention results in a decrease in the fuel used in the heater by over 40 percent. Less steam is generated by heat exchange with hot streams because the recovery unit operates with more heat efficiency. Overall, the hydroprocessing apparatus with a hot stripper and a cold stripper can run for operating costs that are $2.5 million less per year than the conventional hydroprocessing apparatus with a single stripper.

The capital costs for the same apparatus are also reduced. Although two strippers are slightly more expensive than one stripper, the fired heater is approximately 40 percent smaller due to its lower duty. As a result, the two-stripper invention results in $1.6 million reduction in capital equipment expenses.

The present invention which adds a vessel to the recovery unit surprisingly results in less operational cost and capital cost.

Preferred embodiments of this invention are described herein, including the best mode known to the inventors for carrying out the invention. It should be understood that the illustrated embodiments are exemplary only, and should not be taken as limiting the scope of the invention.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated. Pressures are given at the vessel outlet and particularly at the vapor outlet in vessels with multiple outlets.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A hydroprocessing process comprising:

hydroprocessing a hydrocarbon feed in a hydroprocessing reactor to provide a hydroprocessing effluent stream;

separating the hydroprocessing effluent stream into a relatively cold hydroprocessing effluent stream and a relatively hot hydroprocessing effluent stream, comprising separating said hydroprocessing effluent stream in a hot separator to provide a hot separator overhead stream comprising a portion of said cold hydroprocessing effluent stream and a hot separator bottoms stream and separating the hot separator bottoms stream in a hot flash drum to provide a hot flash overhead stream comprising a portion of said cold hydroprocessing effluent stream and a hot flash bottoms stream comprising the hot hydroprocessing effluent stream;

stripping the relatively cold hydroprocessing effluent stream in a cold stripper to provide a cold stripped stream;

stripping the relatively hot hydroprocessing effluent stream in a hot stripper to provide a hot stripped stream; and feeding the cold stripped stream and the hot stripped stream to a product fractionation column.

2. The hydroprocessing process of claim 1 further comprising fractionating the cold stripped stream and the hot stripped stream in the product fractionation column to provide product streams.

3. The hydroprocessing process of claim 2 further comprising heating said hot stripped stream in a fired heater, and bypassing the cold stripped stream around the fired heater.

4. The hydroprocessing process of claim 2 further comprising passing said cold stripped stream to the product fractionation column at a higher elevation than the hot stripped stream.

5. The hydroprocessing process of claim 1 further comprising separating the hot separator overhead stream in a cold separator to provide a cold separator overhead stream and a cold separator bottoms stream comprising a portion of said cold hydroprocessing effluent stream.

6. The hydroprocessing process of claim 5 further comprising separating said cold separator bottoms stream in a cold flash drum to provide a cold flash overhead stream and a cold flash bottoms stream, said cold flash bottoms stream comprising said cold hydroprocessing effluent stream.

7. The hydroprocessing process of claim 1 further comprising separating said hot flash overhead stream in a cold flash drum to provide a cold flash overhead stream and a cold flash bottoms stream, said cold flash bottoms stream comprising said cold hydroprocessing effluent stream.

8. The hydroprocessing process of claim 1 further comprising fractionating a cold stripper overhead stream from said cold stripper and a hot stripper overhead stream from said hot stripper in a debutanizer column.

9. The hydroprocessing process of claim 1 further comprising taking said cold stripped stream from a bottom of said cold stripper; feeding an entirety of said cold stripped stream to said product fractionation column and taking said hot stripped stream from a bottom of said hot stripper.

10. A hydroprocessing process comprising:

hydroprocessing a hydrocarbon feed in a hydroprocessing reactor to provide a hydroprocessing effluent stream;

separating the hydroprocessing effluent stream into a cold hydroprocessing effluent stream and a hot hydroprocessing effluent stream, comprising separating said hydroprocessing effluent stream in a hot separator to provide a hot separator overhead stream comprising a portion of said cold hydroprocessing effluent stream and a hot separator bottoms stream and separating the hot separator bottoms stream in a hot flash drum to provide a hot flash overhead stream comprising a portion of said cold hydroprocessing effluent stream and a hot flash bottoms stream comprising the hot hydroprocessing effluent stream;

stripping the cold hydroprocessing effluent stream in a cold stripper to provide a cold stripped stream;

stripping the hot hydroprocessing effluent stream in a hot stripper to provide a hot stripped stream;

heating the hot stripped stream in a fired heater, and bypassing the cold stripped stream around the fired heater; and fractionating the cold stripped stream and the hot stripped stream in a product fractionation column to provide product streams.

11. The hydroprocessing process of claim 10 further comprising separating the hot separator overhead stream in a cold separator to provide a cold separator overhead stream and a cold separator bottoms stream comprising a portion of said cold hydroprocessing effluent stream.

12. The hydroprocessing process of claim 11 further comprising separating said cold separator bottoms stream in a cold flash drum to provide a cold flash overhead stream and a cold flash bottoms stream, said cold flash bottoms stream comprising said cold hydroprocessing effluent stream.

13. The hydroprocessing process of claim 11 further comprising separating said hot flash overhead stream in a cold flash drum to provide a cold flash overhead stream and a cold flash bottoms stream, said cold flash bottoms stream comprising said cold hydroprocessing effluent stream.

14. A hydroprocessing process comprising:

hydroprocessing a hydrocarbon feed in a hydroprocessing reactor to provide a hydroprocessing effluent stream;

separating said hydroprocessing effluent stream in a hot separator to provide a hot separator bottoms stream and a hot separator overhead stream comprising a portion of a relatively cold hydroprocessing effluent stream and separating the hot separator bottoms stream in a hot flash drum to provide a hot flash overhead stream comprising a portion of said relatively cold hydroprocessing effluent stream and a hot flash bottoms stream comprising a relatively hot hydroprocessing effluent stream;

stripping said relatively cold hydroprocessing effluent stream which is a portion of said hydroprocessing effluent stream in a cold stripper to provide a cold stripped stream;

stripping said relatively hot hydroprocessing effluent stream which is a portion of said hydroprocessing effluent stream in a hot stripper to provide a hot stripped stream; and fractionating the cold stripped stream in a product fractionation column to provide product streams.

* * * * *